US005865563A

United States Patent [19]

Bonds

[11] Patent Number: 5,865,563

[45] Date of Patent: Feb. 2, 1999

[54] METHOD FOR BLENDING AND WINDROWING ASPHALT

[76] Inventor: Larry Russell Bonds, 15 County Rd. 164, Iuka, Miss. 38852

[21] Appl. No.: 792,965

[22] Filed: Jan. 24, 1997

Related U.S. Application Data

[62] Division of Ser. No. 517,663, Aug. 22, 1995, Pat. No. 5,697,731.

[51] Int. Cl.[6] ..... E01C 19/22; E02F 3/76

[52] U.S. Cl. ..... 404/72; 404/79; 404/92; 404/108

[58] Field of Search ..... 37/231, 142.5; 172/701.1, 786, 787, 788, 811, 815, 828; 414/607; 404/96, 101, 108, 110, 92, 72, 75, 82, 179; 405/179

[56] References Cited

U.S. PATENT DOCUMENTS

| | | | |
|---|---|---|---|
| 3,424,251 | 1/1969 | Bouley | 172/815 X |
| 3,479,755 | 11/1969 | Schropp | 37/8 |
| 5,529,434 | 6/1996 | Swisher, Jr. | 37/8 |
| 5,531,036 | 7/1996 | Shinkle | 37/405 |
| 5,560,129 | 10/1996 | Rothbart | 37/231 |

*Primary Examiner*—James Lisehora
*Attorney, Agent, or Firm*—Nilles & Nilles, S.C.

[57] ABSTRACT

A method for blending and windrowing hot plant mix asphalt which has been deposited onto a roadway in preparation for paving the roadway utilizes a V-shaped plow formed by a first plowing member extending in a first direction, and a second plowing member extending in a second direction, with rearward ends of each of the first and second plowing member being connected at a vertex and the opposite forward ends being spaced apart to form the open side of the V-shaped plow. The V-shaped plow further comprises an opening in the vertex and a movable gate for adjusting the size of the opening in the vertex. The V-shaped plow is further provided with an attachment device for attaching the V-shaped plow to an earth moving implement, such as a front end loader. Movement of the V-shaped plow along the roadway causes the hot asphalt to be thoroughly blended and deposited from the opening into a perfect windrow having the desired amount of asphalt for paving the roadway at issue.

3 Claims, 5 Drawing Sheets

METHOD FOR BLENDING AND WINDROWING ASPHALT

This application is a division of application Ser. No. 08/517,663, filed Aug. 22, 1995, now U.S. Pat. No. 5,697,731.

BACKGROUND OF THE INVENTION

1. Field of the Invention

The present invention relates to an a method for blending and windrowing hot plant mix asphalt used in paving and resurfacing roadways.

2. Discussion of the Related Art

Hot plant mix asphalt is a material commonly used throughout the country to pave and resurface roadways. Advancements in asphalt technology, both in the manufacturing of equipment and in the construction process, have enabled road builders to improve the construction and performance of modern highways, particularly in respect to smoothness and uniformity of the road surface. Smoothness of the surface directly affects both noise levels from vehicles traveling on the road and longevity of the surface. In fact, most roadways are now constructed in accordance with strict performance parameters concerning, among other items, smoothness, uniformity, and longevity. Moreover, many specifying agencies have adopted bonus plans for contractors who meet or exceed such performance parameters to earn extra pay, or in contrast, penalties for those who do not.

The processes for producing asphalt and paving roadways include mining and crushing aggregate material, grading and blending the material, transporting and charging feeders of an asphalt plant, reblending and mixing the material with hot asphalt liquid, dumping the hot asphalt into storage systems and dump trucks, hauling the material to the construction site, further dumping and transferring the material into a paver, and finally properly placing the material onto the road surface. Care must be taken at every step of the process to ensure that the material is thoroughly mixed in order to lay down a sufficiently smooth surface. From the standpoint of the road building contractor, special care must be given to the last two steps—transferring material to the construction site and the final paving process—otherwise quality is lost. Problems encountered by road building contractors which adversely affect smoothness include segregation of material, truck bumps, logistical difficulties in transporting material, and cold joints.

Hot plant mix asphalt is composed of liquid asphaltic cement mixed with different sizes of aggregate. In order for asphalt pavement to be of maximum quality, smooth and long-lasting, it must be uniformly blended, without any segregation of material. As with any type of material, hot plant mix asphalt tends to segregate with handling. Even though the material may have been thoroughly mixed and blended at the plant, the asphalt will nonetheless tend to segregate by the time it has been transported to and laid down on the road surface.

Conventional paving operations often require that a dump truck back up to a paver in order to deposit the material into the paver. Some contractors use the paver to propel both the paver and dump truck during the paving process. Occasionally the dump truck may bump into the paver, causing a momentary disruption in the paving process. The disruption results in a small bump in the road referred to in the industry as "truck bumps."

Because conventional paving operations require a dump truck to deposit asphalt directly to the paver, delivery of multiple loads of asphalt must be precisely timed so that a new, fully loaded truck arrives just as the previous truck has been emptied in order to maintain the pace of the paving operation. Disruptions in the delivery of asphalt can cause cold joints and other irregularities in the pavement.

Conventional techniques to address such problems have typically involved development of various sophisticated pieces of equipment which are extremely expensive and often add a host of other operating problems to the process. Some of those methods incorporate the use of equipment which have a large capacity for holding asphalt material. Such devices are useful in reducing the number of times that material must be transferred from a dump truck to paver, thereby reducing the number of "truck bumps" and cold joints, but not eliminating the problem altogether. Numerous other ideas have been tried with less-than-satisfying results.

SUMMARY OF THE INVENTION

A method for blending and windrowing hot plant mix asphalt which has been deposited onto a roadway in preparation for paving the roadway is disclosed.

The method comprises dumping from a dump truck hot asphalt onto a roadway, plowing the dumped asphalt with a V-shaped plow having a central opening thereby mixing and blending the asphalt into a windrow, controlling the amount of asphalt deposited in the windrow by controlling a gate at the opening of the V-shaped plow, and accumulating the windrow of asphalt with a paver and thereby paving the road surface.

Movement of the V-shaped plow along the roadway causes the hot asphalt to be thoroughly reblended and deposited from the opening into a perfect windrow having the desired amount of asphalt for paving the roadway at issue. Thoroughly mixing the asphalt immediately prior to the paving process maximizes the smoothness, uniformity and longevity that can be achieved with the material.

In addition, the invention disclosed herein provides for a continuous supply of asphalt material to a paving machine thereby eliminating "truck bumps" which occur when dump trucks deposit loads directly into the paving equipment. A continuous supply of material also eliminates cold joints and segregation spots where, in a conventional operation, each truck exchange was made at the paving machine. The invention further enables the paver to be just a paver, and not also have to propel a heavy dump truck up steep grades or around sharp curves of a roadway.

Accordingly, the primary objects of the invention are to provide a method for blending and windrowing hot plant mix asphalt for use in paving roadways; for reblending asphalt immediately prior to the paving operation; to eliminate truck bumps, segregation spots and cold joints in asphalt pavement; and to improve and maximize smoothness, uniformity and longevity of asphalt pavements.

The invention eliminates the manpower heretofore needed to correct flaws in the paving process because the flaws do not exist. The invention allows the contractor to be more productive because there is no down time waiting on the truck exchange.

Other objects and advantages of the invention will become apparent from the following description taken in connection with the accompanying drawings which set forth, by way of illustration and example, certain preferred embodiments of the invention.

BRIEF DESCRIPTION OF THE DRAWINGS

The drawings, which constitute part of the specification and include exemplary embodiments of the present invention, include the following.

DETAILED DESCRIPTION OF THE PREFERRED EMBODIMENTS

Referring to FIGS. 1, 4, 5, 6 and 7, the present invention relates to a method for blending and windrowing hot plant mix asphalt for paving roadways. The preferred apparatus for performing this method is especially designed to reblend and windrow asphalt which has been deposited onto a roadway in preparation for paving the roadway.

Figure 8:
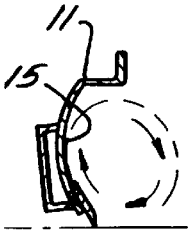
FIG. 8 is a cross-section view of first plowing member from the view point of line 8—8 on FIG. 5.
Figure 7:
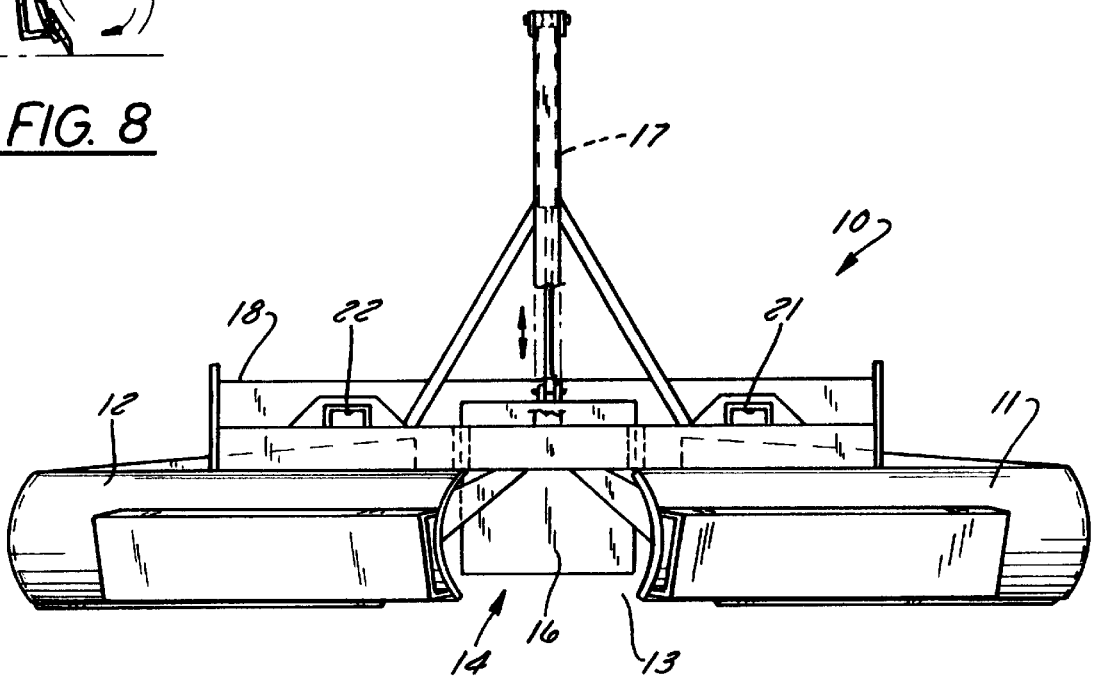
FIG. 7 is a rear view of the V-shaped plow of the present invention.
Figure 9:
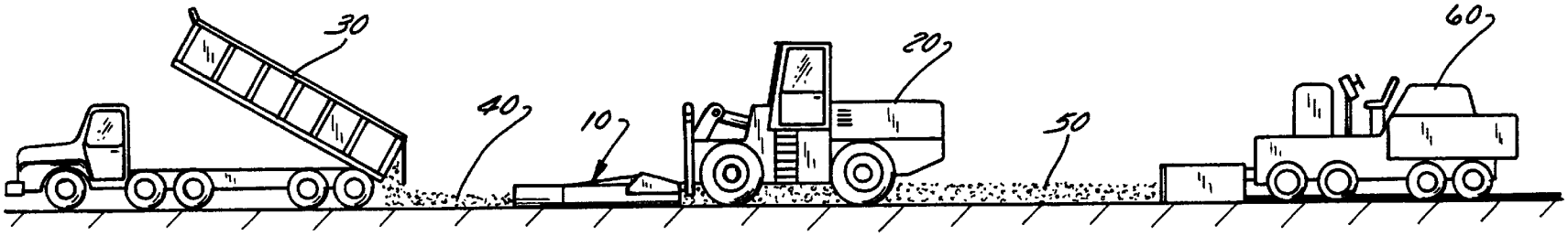
FIG. 9 is an elevation view demonstrating the use of the V-shaped plow and the method of the present invention disclosed herein.

The apparatus essentially comprises a V-shaped plow 10. The V-shaped plow 10 is formed by a first plowing member 11 extending in a first direction, and a second plowing member 12 extending in a second direction. The first and second plowing members 11 and 12 are connected at a vertex 13 of the V-shaped plow 10. In other words, the rearward ends of the first and second plowing members 11 and 12 are joined at the vertex 13 of the V, and the opposite, forward ends of the first and second plowing members form the open face of the V. The open forward ends of the first and second plowing members are spaced apart a distance "d" which is approximately equal to the width of a single traffic lane on a typical highway. The interior surface 15 of the first and second plowing members 11 and 12 are comprised of a concave plowing surface as shown in FIG. 8.

Figure 5:
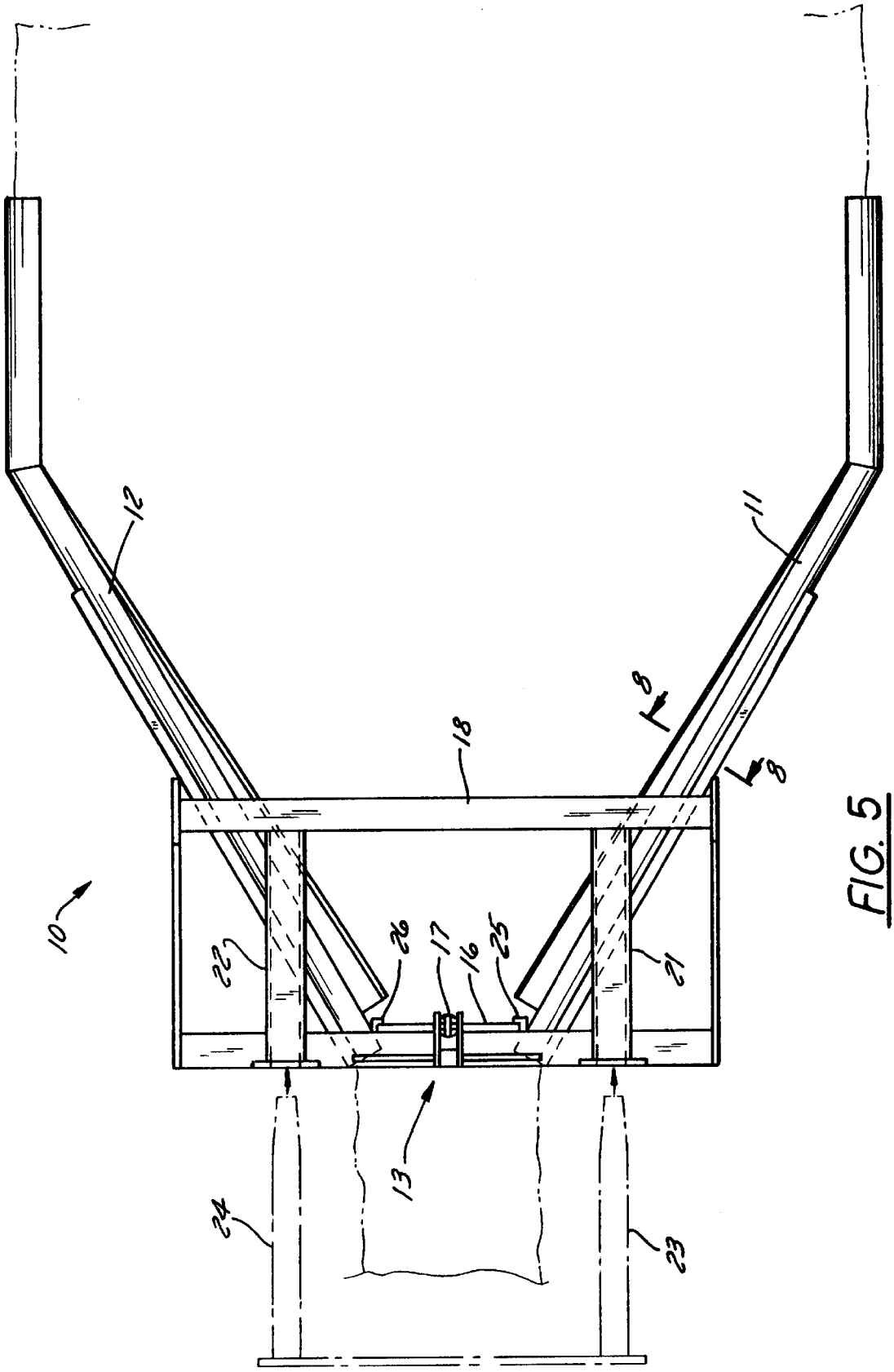
FIG. 5 is a top view of the V-shaped plow.
Figure 6:
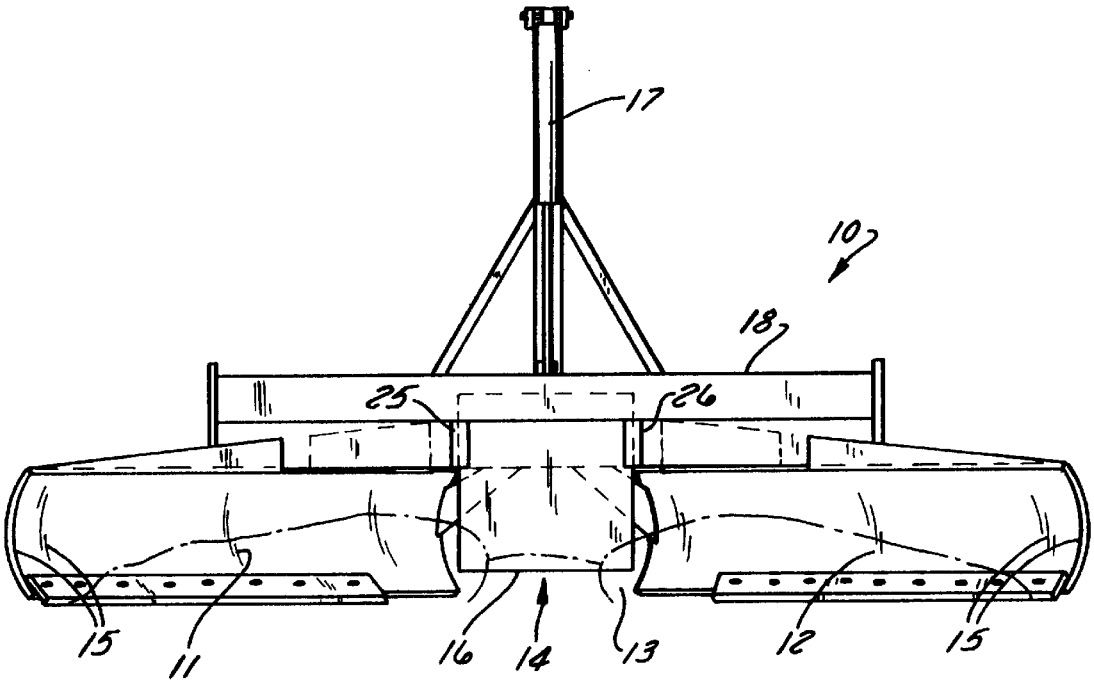
FIG. 6 is a front view of the V-shaped plow of the present invention.

The V-shaped plow 10 is further provided with an opening 14 that is much shorter than the distance "d." As can be clearly seen in the drawings and in FIG. 5 in particular, each of the plowing members is substantially longer than the length of the opening 14 and, in fact, is more than twice as long as the opening 14 in the vertex. A moveable gate 16 adjusts the size of the opening 14 in the vertex 13. The moveable gate 16 comprises a vertical plate which is adjustably moveable in an upward direction to open the opening in the vertex, and movable in a downward direction to close the opening in the vertex. The gate is opened and closed through the use of a hydraulic cylinder 17. The hydraulic cylinder 17 is attached to an upper surface of the vertical plate, and extends vertically therefrom. Consequently, the vertical stroke of the hydraulic cylinder 17 raises and lowers the gate 16 to open and close the opening 14 in the vertex. The hydraulic cylinder 17 is powered from a remote source of hydraulic fluid, which is typically included in earth moving equipment such as front end loaders 20 and the like.

The V-shaped plow 10 is further provided with attachment means for attaching it to a front end loader 20 or other earth moving implement typically used in road construction. The attachment means comprises a metal brace 18 connected to the upper portions of the first and second plowing members. The metal brace 18 includes first and second horizontal, hollow metal chutes 21 and 22 which are receptable to a pair of fork lift forks 23 and 24 on the front end loader 20. The forks slide into the interior of the chutes. The metal brace 18 also has right and left slides or ridges 25 and 26 for holding the moveable gate and an upward projecting brace for holding the hydraulic cylinder. The gates slide up and down within the ridges.

As the V-shaped plow is slid or moved forward down the roadway, hot plant mix asphalt which has been deposited onto the roadway is plowed by the first and second plowing members toward the center or vertex of the V-shaped plow. Movement of the V-shaped plow causes the asphalt to be plowed and scraped from the roadway upward along the concave plowing surface until gravity causes the asphalt to cascade downwardly, as shown in FIG. 8.

Figure 1:
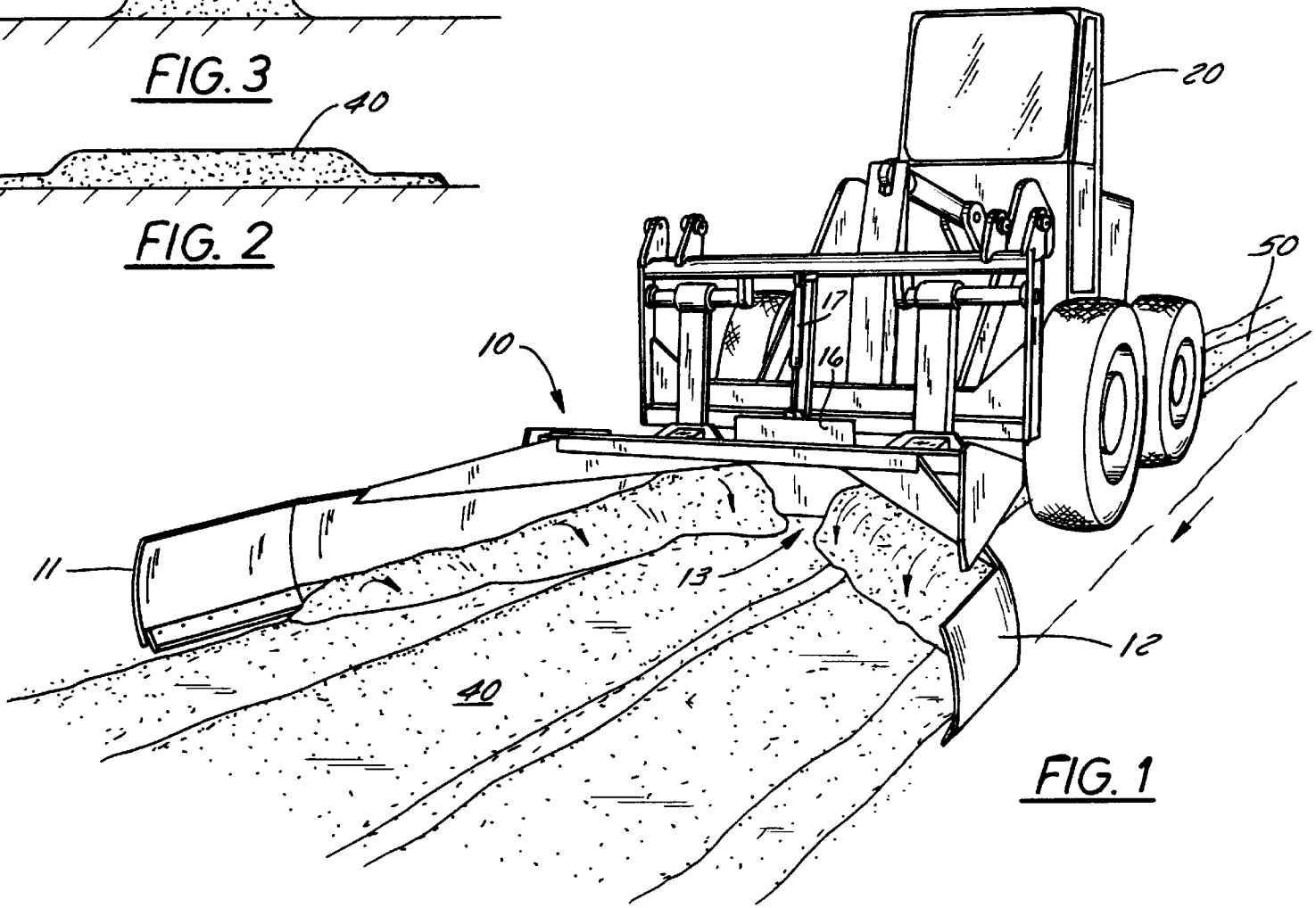
FIG. 1 is a perspective view of the present invention of an apparatus and method for blending and windrowing hot plant mix asphalt through the use of V-shaped plow in connection with the process for paving a roadway.
Figure 2:
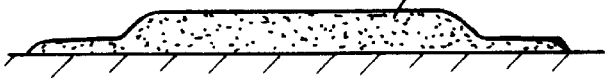
FIG. 2 is a cross-section view of asphalt which has been haphazardly dumped from a dump truck onto a roadway.
Figure 3:
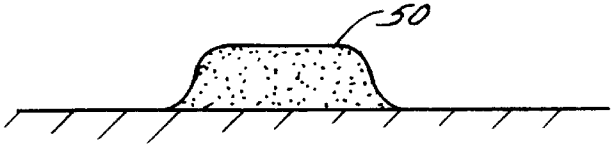
FIG. 3 is a cross-section view of asphalt which has been reblended and windrowed in accordance with the present invention.
Figure 4:
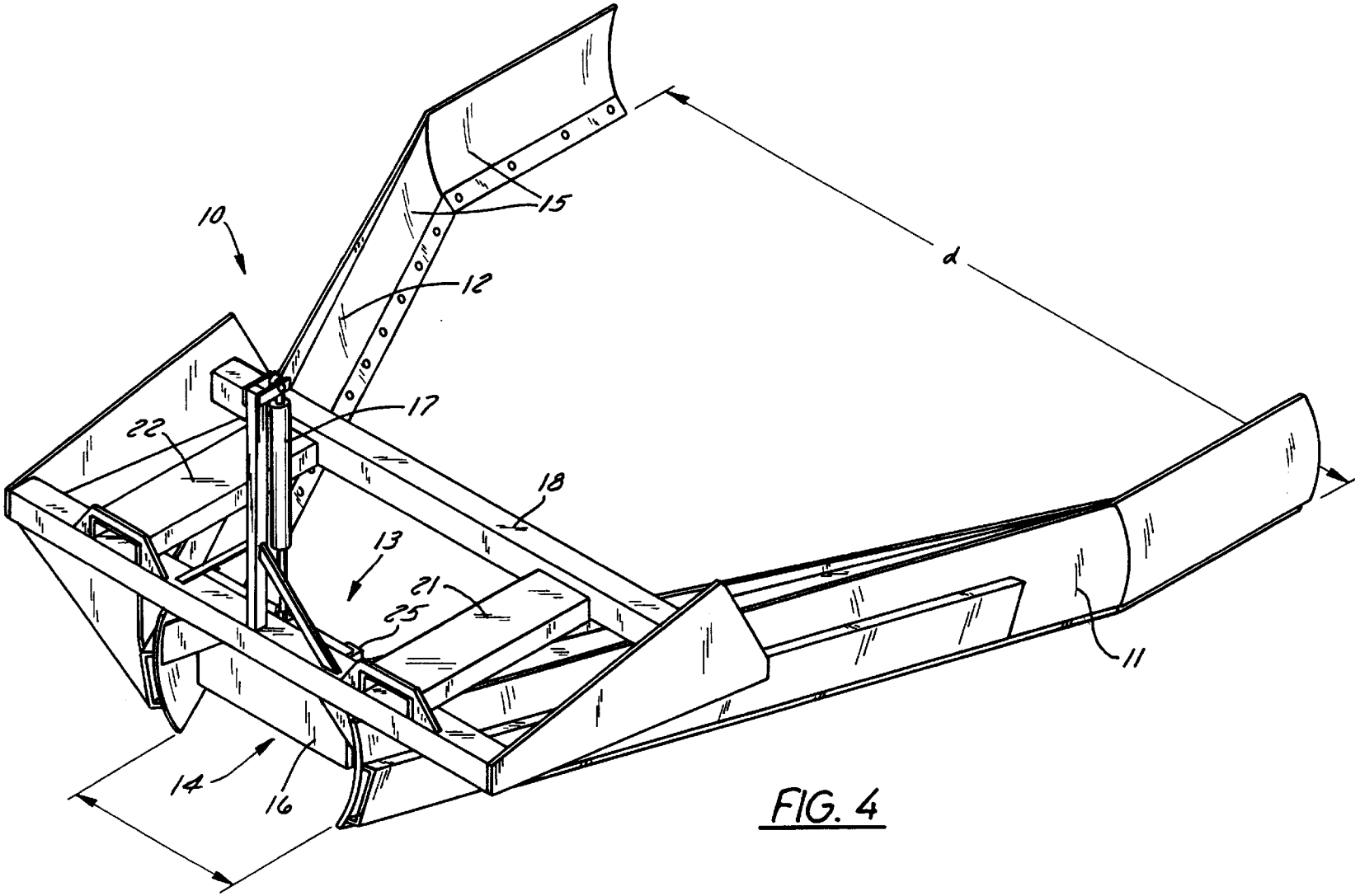
FIG. 4 is a perspective view of the V-shaped plow usable to perform the method of the present invention.

FIG. 2 shows a cross-section of asphalt 40 which has been dumped from the tail gate of a dump truck 30 onto a roadway in preparation for paving the road. As the V-shaped plow 10 is moved forward along the road, the combination of the cascading effect of the concave plowing surface, plus the angled first and second plowing members which gather the asphalt toward the center of the V-shaped plow, causes the asphalt to become thoroughly blended. The asphalt is then deposited from the rear of the V-shaped plow, through the opening thereof, into a windrow 50 having a desired amount of asphalt. FIG. 3 shows a cross-section of a windrow of asphalt. The gate can be opened and closed to adjust the amount of asphalt deposited in the windrow in order to match the amount needed to pave the roadway.

Referring to FIGS. 1, 2, 3 and 9, the method of paving a roadway with hot plant mix asphalt includes first, depositing from the tail gate of a dump truck a load of hot mix asphalt onto a roadway to be surfaced. Second, using an earth moving implement such as a front end loader, moving a V-shaped plow having the features mentioned above in a vertical direction along the roadway. As the V-shaped plow is moved forward along the roadway, the asphalt is plowed toward the vertex of the V-shaped plow and deposited through the opening thereof into a windrow.

The method further comprises adjusting the size of the opening by raising or lowering a moveable gate in the vertex in order to control the amount of asphalt deposited in the windrow. The gate is opened or closed by raising or lowering, respectively, a hydraulic cylinder controlled from the cab of the front end loader or other implement.

Finally, the method comprises accumulating the windrow of asphalt with an asphalt windrow paver 60 such as the type disclosed in U.S. Pat. No. 4,200,408 or U.S. Pat. No. 5,073,063, which are incorporated herein by reference, and thereby paving the roadway.

Naturally, changes may be made in the details of construction of the present invention without departing from the spirit of the invention. Therefore, specific structural details disclosed above are not intended to limit the spirit or scope of the invention, but are merely presented to provide a basis for teaching one skilled in the art to variously employ the present invention, especially as defined in the following claims.

Therefore, I claim as my invention the following:

1. A method comprising:

dumping a load of hot plant mix asphalt from a dump truck and onto a roadway to be surfaced;

blending and windrowing the dumped asphalt using a steeply V-shaped plow comprising a first plowing member extending in a first direction at an acute angle with respect to a longitudinal centerline of said plow, a second plowing member extending in a second direction at an acute angle with respect to said longitudinal centerline, said first and second plowing members converging towards an opening located at a vertex of said plow and terminating at the opening, each of said first and second plowing members having a longitudinal length that is substantially longer than a longitudinal length of the opening in the vertex, wherein movement of the V-shaped plow along the roadway in contact with the dumped asphalt 1) causes the dumped asphalt to be blended as the dumped asphalt is plowed by the first and second plowing members toward the vertex and 2) causes the blended asphalt to be deposited through the opening into a windrow; and accumulating the windrow of asphalt with a windrow asphalt paver and paving the road surface using the windrow asphalt paver.

2. The method according to claim 1, further comprising adjusting the size of the opening in order to control the amount of asphalt deposited in the windrow.

3. The method according to claim 2, wherein the step of adjusting the size of the opening comprises raising or lowering a moveable gate.

* * * * *